United States Patent [19]

Mode

[11] Patent Number: 4,820,893

[45] Date of Patent: Apr. 11, 1989

[54] TWO-CELLED EXPANDABLE MICROWAVE COOKING SLING

[75] Inventor: Duane R. Mode, Bloomington, Minn.

[73] Assignee: Waldorf Corporation, St. Paul, Minn.

[21] Appl. No.: 189,205

[22] Filed: May 2, 1988

[51] Int. Cl.[4] ..... H05B 6/80; B65B 25/22

[52] U.S. Cl. ..... 219/10.55 E; 219/10.55 F; 426/107; 426/111; 426/243; 99/DIG. 14; 229/DIG. 3

[58] Field of Search ..... 219/10.55 E, 10.55 F; 426/107, 109, 111, 113, 114, 241, 243, 234; 99/DIG. 14; 126/390; 229/DIG. 3

[56] References Cited

U.S. PATENT DOCUMENTS

| | | | |
|---|---|---|---|
| 2,199,584 | 5/1940 | Bemis . | |
| 2,686,129 | 8/1954 | Seiferth . | |
| 2,876,114 | 3/1959 | Robertson et al. | 426/129 |
| 2,939,793 | 6/1960 | Richman . | |
| 3,359,889 | 12/1967 | Young et al. . | |
| 3,727,827 | 4/1973 | Stice | 229/DIG. 3 |
| 3,876,812 | 4/1975 | Peters | 426/113 |
| 4,183,435 | 1/1980 | Thompson | 219/10.55 E |
| 4,529,089 | 7/1985 | Gasbarra | 219/10.55 EX |
| 4,553,010 | 11/1985 | Bohrer et al. | 219/10.55 E |
| 4,571,340 | 2/1986 | Ferrante et al. | 426/113 |
| 4,594,492 | 6/1986 | Maroszek | 219/10.55 E |
| 4,641,005 | 2/1987 | Seiferth | 219/10.55 E |
| 4,734,288 | 3/1988 | Engstrom et al. | 426/107 |

*Primary Examiner*—Philip H. Leung

*Attorney, Agent, or Firm*—Dorsey & Whitney

[57] ABSTRACT

A collapsible package for use in surface heating of food by microwave energy comprises first and second sling enclosures. Each sling enclosure comprises a pair of parallel, opposed, substantially rectangular wall panels, the ends of which are joined by collapsible bridge panels. The bridge panels are movable between a collapsed position in which the wall panels lie against each other and an expanded position in which the wall panels are held in spaced relation to each other. The second sling enclosure is joined to the first sling enclosure at a center fold line between adjacent wall panels of said first and second sling enclosures. A generally rectangular strip of thin, flexible material capable of converting microwave energy into heat is affixed between the two opposed side walls of the first and second sling enclosures that are not connected at the center fold line. One of two opposed edges of said strip if affixed to each side wall. The portion of the flexible strip that is intermediate these two opposed edges is draped over the two side walls joined at the center fold line to form a sling of flexible material in each of the first and second sling enclosures. The present invention also encompasses a flat blank to which the strip of flexible material capable of converting microwave energy into heat can be attached, with the blank being folded and glued into a configuration that can be easily erected into the package previously described.

6 Claims, 1 Drawing Sheet

TWO-CELLED EXPANDABLE MICROWAVE COOKING SLING

TECHNICAL FIELD

The present invention relates to food packaging suitable for use in a microwave oven. More particularly, the present invention relates to a package in which roughly cylindrical food objects, such as egg rolls, sausages, corn dogs, shish kebobs or other skewered foods, may be packaged and cooked with surface browning.

BACKGROUND ART

In recent years, microwave ovens have become increasingly popular. This has created an increasing demand for economical, simple, disposable containers which, when used in a microwave oven, produce cooking results, including surface browning and crisping, comparable to those to which people are accustomed to experiencing with conventional ovens. For consumer convenience, it is desirable that the package be constructed so that the food item, together with all or a portion of the package, can be placed directly in the oven.

Paperboard cartons have been found to be an economical way to meet many microwave packaging requirements. In particular, a number of cartons for browning microwave foods have been successfully sold that are made from paperboard to which a metallized plastic film has been laminated, with the thin metallized layer being sandwiched between the plastic film and the paperboard. A suitable adhesive is used to hold the laminated layers together. One laminated material of this kind is shown in U.S. Pat. No. 4,641,005.

Although microwave browning packages of several kinds are now widely sold and the surface browning capability of a metallized film-paperboard laminate used in such packages is widely accepted, the effect of unusual food and package shapes, of multiple layers of microwave absorbing materials and of other specialized package configurations on cooking results is not well understood. This is apparently attributable to the complex combination of reflections, refractions and absorptions of microwave radiation occuring in the oven, the food and the packaging. It is also attributable to the different way in which microwaves cook food, as compared to the heating modes of conventional ovens. Accordingly, development of specific package configurations has proceeded slowly and empirically, as the microwave cooking possibilities of various food items are explored. Each food item and each packaging configuration seems to have its own cooking characteristics.

Many of the microwave cooking packages first developed were for products such as pizza and popcorn. Because of their specialized configuration, such as suitability for cooking flat dough or for maintaining popcorn kernels in a pool of hot oil, these packages are not effective for food items that requires browning on a curved surface. Accordingly, there is a need for packaging for effective microwave cooking of a food item having elongated curved surfaces, such as egg rolls, sausages and other similarly cylindrical items.

SUMMARY OF THE INVENTION

In accordance with the present invention, a collapsible package for use in surface heating of food by microwave energy comprises first and second sling enclosures. Each sling enclosure comprises a pair of parallel, opposed, substantially rectangular wall panels, the ends of which are joined by collapsible bridge flaps. The bridge flaps are movable between a collapsed position in which the wall panels lie against each other and an expanded position in which the wall panels are held in spaced relation to each other. The second sling enclosure is joined to the first sling enclosure at a center fold line between adjacent wall panels of said first and second sling enclosures. A generally rectangular strip of thin, flexible material capable of converting microwave energy into heat is affixed between the two opposed side walls of the first and second sling enclosures that are not connected at the center fold line. One of two opposed edges of said strip is affixed to each side wall. The portion of the flexible strip that is intermediate these two opposed edges is draped over the two side walls joined at the center fold line to form a sling of flexible material in each of the first and second sling enclosures. The present invention also encompasses a flat blank to which the strip of flexible material capable of converting microwave energy into heat can be attached, with the blank being folded and glued into a configuration that can be easily erected into the package previously described. The fat blank is made from paperboard material. The flexible material is made from a plastic film that is metallized or that bears a layer of some microwave interactive material.

A primary objective of the present invention is to provide a package for microwave cooking of a food item having a curved surface that requires surface heating.

Another objective of the invention is to provide a package that can hold a pair of food items of generally cylindrical shape.

A further objective of the present invention is to provide a simple, collapsible paperboard package for generally cylindrical food items that can be shipped collapsed to accompany food items or erected so that food items can be shipped within the package.

Another objective of the present invention is to provide a paperboard package having a pair of microwave slings that can be produced by a simple "windowing" operation that places a flat piece of microwave reactive material on a flat paperboard blank that is later folded, glued and erected.

These and other objectives of the present invention will become apparent with reference to the drawings, the description of the preferred embodiment and the appended claims.

DESCRIPTION OF THE PREFERRED EMBODIMENT

Figure 1:
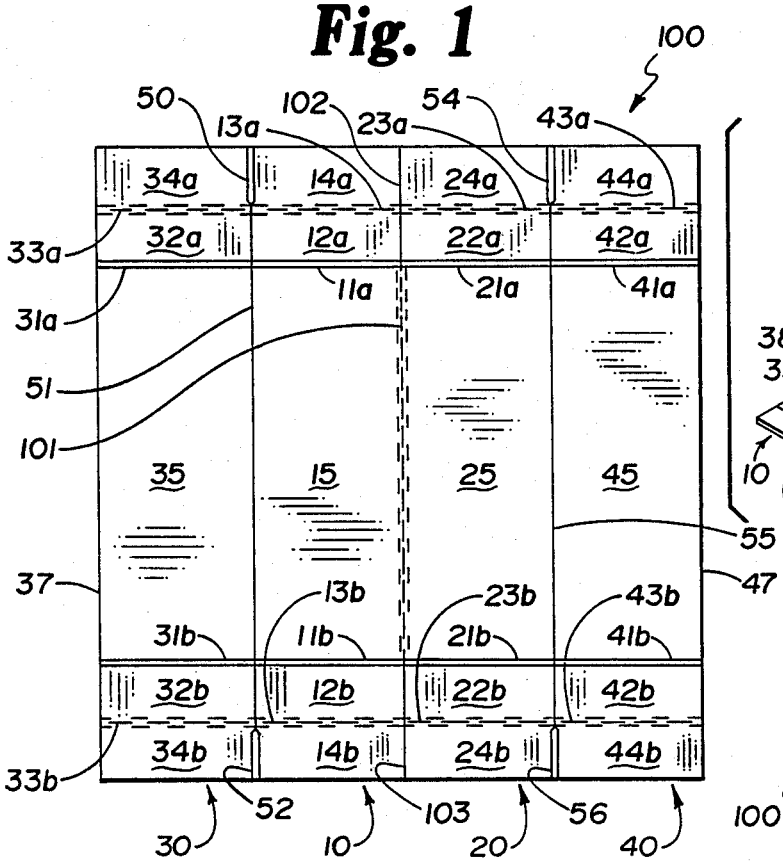
FIG. 1 is a top plan view of a paper blank of the present invention showing profile, cuts and scores.

As best seen in FIG. 1, a blank 100 in accordance with the present invention is made from four elongated strips 10, 20, 30, 40 of paperboard or a similar material. (In the drawings, double lines indicate scores used to form fold lines. Single solid lines indicate cuts or free edges.) Each of the four elongated strips 10, 20, 30, 40 is substantially rectangular and substantially equal in size to the other strips. The four strips 10, 20, 30, 40 are disposed laterally adjacent each other with the same orientation and with their end edges aligned. In this configuration, strips 10, 20 are referred to as the center strips. The remaining strips 30, 40 are the outer strips.

Center strip 10 is made up of several panels. Main panel 15 occupies the middle of the strip 10, with pairs of additional panels (discussed below) at either end. Strip 20 is identical in configuration to strip 10. It has a main panel 25, which is joined to the main panel 15 of strip 10 along a central fold line 101, and a pair of additional panels at either end. Central fold line 101 is defined by alternating cuts and scores (preferably of approximately equal length). The outer strips 30, 40 also have main panels 35, 45, respectively. At either end of the outer strips 30, 40 are pairs of additional panels similar to those present in the center strips 10, 20.

The end panels of the various strips 10, 20, 30, 40 are defined by various fold lines demarking areas at the ends of the strips. In center strip 10, at each end of the main panel 15 is a fold line **11*a*, 11*b* (formed by scores), defining a pair of generally rectangular bridge flaps 12*a*, 12*b*. The outer boundary of each bridge flap 12*a*, 12*b* is defined by an additional fold line 13*a*, 13*b* (formed by alternating cuts and scores, preferably of approximately equal length), defining a pair of glue flaps 14*a*, 14*b***.

The panel structure of each of the other strips 20, 30, 40 is the same as that of the strip 10. That is, each has a pair of inner fold lines defining a pair of bridge flaps and a pair of outer fold lines defining a pair of glue flaps. The numbers of these flaps as shown in FIG. 1 correspond to the numbering format for the bridge and glue flaps in strip 10, so that corresponding parts can be easily identified.

As noted previously, the two center strips 10, 20 are joined along a center fold line 101. This center fold line 101 extends between the abutting ends of inner fold lines **11*b*, 21*b*, at one end of the strips 10, 20, and the abutting ends of inner fold lines 11*a*, 21*a* at the other end of the strips 10, 20. Beyond each of the ends of the center fold line 101 is a cut 102, 103 that defines adjacent but free edges of the bridge flaps 12*a*, 12*b*, 22*a*, 22*b* and glue flaps 14*a*, 14*b*, 24*a*, 24*b* at the respective ends of the strips 10, 20**.

Outer strip 30 is joined to center strip 10 at short fold lines 50, 52 defined by scores. The fold lines 50, 52 extend only from the outer ends of the strips 10, 30 to the abutting ends of outer fold lines **13*a*, 33*a* and 13*b*, 33*b* at each end of the strips 10, 30. Similarly, outer strip 40 is joined to center strip 20 at short fold lines 54, 56 defined by scores. These fold lines 54, 56 also extend from the outer edges of the strips 20, 40 only as far as the outer fold lines 23*a*, 43*a* and 23*b*, 43*b* of the strips 20, 40. Between each of the fold lines 50, 52 and 54, 56 are extended cuts 51, 55, respectively, that define adjacent but free edges of the adjacent strips 10, 30 and 20, 40**, respectively.

Figure 2:
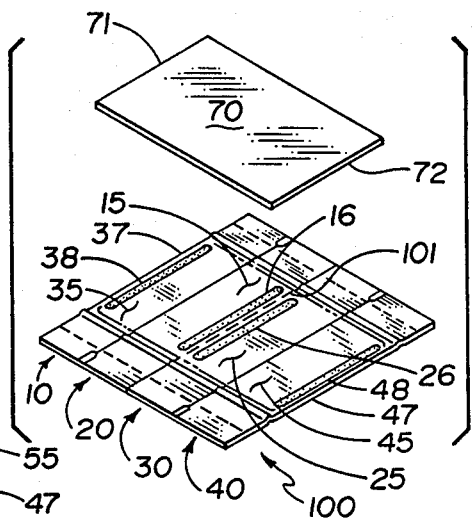
FIG. 2 is an exploded pictorial view of the paper blank of FIG. 1 having a flat film blank suspended thereover which is attached to the paper blank by glue applied to glue areas as shown.
Figure 3:
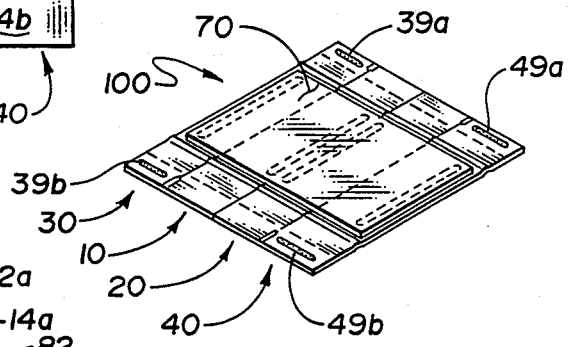
FIG. 3 is a pictorial view of the paper and film blanks joined in primary assembly with additional glue areas for secondary assembly also shown.

Turning next to FIGS. 2 and 3, a substantially rectangular piece of microwave reactive material 70 and its manner of attachment to the blank 100 are shown. The microwave absorbing material 70 is preferably a thin plastic film on which a layer of microwave reactive material has been deposited. For example, the microwave reactive material 70 is preferably a polyester (polyethylene terephthalate or polybutylene terephthalate) or poly-4-methyl-pentene-1 (TPX) that has been metallized or in some other manner provided with a thin layer of microwave reactive material. For example, the material 70 may be one of the preceding plastic films of a thickness from 35–400 gauge (48–92 gauge preferred) and may have received a layer of evaporatively deposited aluminum or sputter-deposited metal compound or alloy, e.g., stainless steel, at an optical density of 0.13 to 0.39. So that the plastic film rather than the metallic layer contacts the food items, the material 70 is oriented such that the metallic layer would be in contact with the upper surface of the blank 100 (as shown in FIG. 2). The material 70 may also be plastic film laminated to suitable lightweight bleached kraft papers (preferably, grade MG or MF papers) having basis weights (in pounds per ream) of 15–90 pounds (preferably, 20–40 pounds). A suitable adhesive for laminating together paper and metallized film is a water-based ethylene/vinyl acetate copolymer made up of about 82–86% by weight ethylene. This same adhesive can be used for gluing the material 70 to the blank 100.

Two opposed outer edges 71, 72 of the microwave reactive material 7 are attached to the corresponding outer edges 37, 47 of outer strips 30, 40. Glue strips 38, 48 placed along the outer edges 37, 47 respectively, provide the bond for attachment of the microwave reactive material 70. In addition, in the preferred embodiment, the portion of the microwave reactive material 70 intermediate the opposed edges.71, 72 is attached to the center strips 10, 20 adjacent the center fold line 101 at glue strips 16, 26, respectively. FIG. 3 shows the microwave reactive material 70 at the completion of primary assembly of the blank 100, with the microwave reactive material 70 lying on top of and across the strips 10, 20, 30, 40. In addition, FIG. 3 shows glue strips **39*a*, 39*b* and 49*a*, 49*b* applied to the glue flaps 34*a*, 34*b* and 44*a*, 44*b*, respectively, of the outer strips 30, 40**. These glue strips are used in secondary assembly, described next.

Figure 4:
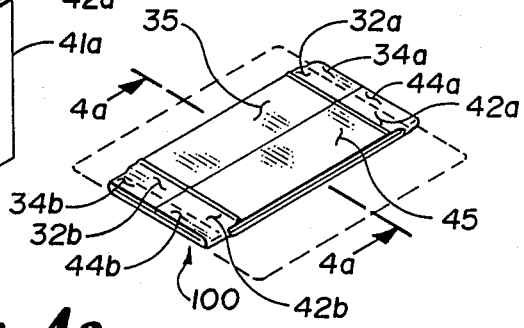
FIG. 4 is a pictorial view of the assembly of FIG. 3 folded into secondary assembly.
Figure 4A:
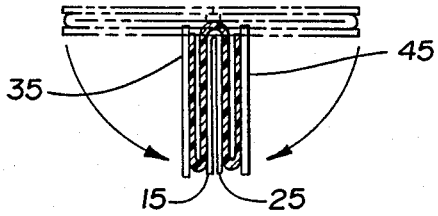
FIG. 4*a* is a cross sectional diagram taken along line 4*a*—4*a* in FIG. 4 with the dual sling enclosures shown folded down from the flat configuration of FIG. 4 in the direction of the arrows.

Turning now to FIGS. 4 and **4*a* the steps of secondary assembly are shown. First, each outer strip 30, 40 is folded inward onto its adjacent center strip 10, 20, utilizing the fold lines 50, 52 and 54, 56. Glue flaps 34*a* and 14*a* are bonded to each other, as are glue flaps 34*b* and 14*b*. Similarly, glue flaps 44*a* and 24*a* are bonded to each other as are glue flaps 44*b* and 24*b*. This produces the flat configuration shown in FIG. 4. Next, the resulting flat configuration is folded at the center fold line 101 by moving the surfaces of strips 10, 20 to which the microwave reactive material 70 is not attached to lie adjacent each other. This produces the elongated multilayered strip shown in cross-section in FIG. 4*a***. Folding into this configuration occurs by movement in the direction shown by the arrows.

Figure 5:
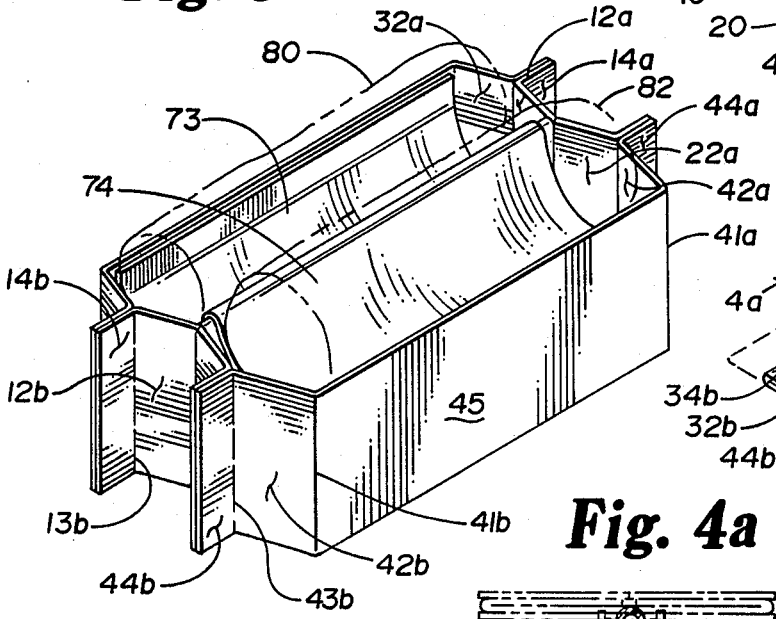
FIG. 5 is a pictorial view of the completed package of the invention unfolded and expanded, ready for receipt of food items such as those shown in phantom lines.

Turning next to FIG. 5, the final, expanded configuration of the blank 100 is shown. In this configuration, the main panels 15, 25 of the center strips 10, 20 remain adjacent each other, while the bridge flaps **12*a*, 32*a***and 12*b*, 32*b* are bent at approximately 90 degree angles relative to their adjacent main panels 15, 35. Similarly, the bridge flaps 22*a*, 42*a* and 22*b* and 42*b* are bent at approximately 90 degrees relative to their adjacent main panels 25, 45. Each joined pair of bridge flaps (e.g., 12*a*, 32*a*) thus forms a collapsible bridge panel with the fold lines that define the adjacent pair of glue flaps (e.g. 13*a*, 33*a*) together defining a collapse fold line. The folding of each pair of bridge flaps (e.g., 12*a*, 32*a*) at the adjacent inner fold lines (e.g., 11*a*, 31*a*) causes the package to expand to produce a pair of slings 73, 74. Each of these slings can accept a food item 80, 82 (shown in phantom lines). Cylindrical food items such as egg rolls, sausages and the like are best suited for cooking in the sling 73, 74, as they effectively utilize the available surface area of the sling 73, 74. Because each sling 73, 74 is made of a thin, flexible film, it can, to a certain extent, conform to the shape of the food item 80, 82 that it holds.

In sum, the package shown and described provides a convenient holder and cooking hammock for a pair of food items having at least one elongated curved surface. It is particularly suitable for food items of generally cylindrical shape. Because the microwave reactive material of the sling 70 can be selected to heat to browning temperatures, the food surfaces in contact with the microwave interactive material 70 can become browned and crisped. If it is desired to brown the entire circumference of a food item, it can be cooked on one surface and rotated for cooking the remaining surfaces. Provided that the slings 73, 74 are of sufficient depth and appropriate width, each sling can contact roughly 180 degrees of the surface of a cylindrical food item. It has been found that an appropriate length for the material 70 (measured between its two affixed edges 75, 76) is approximately pi (3.1416) times the length of a connected pair of bridge flaps, e.g., 12*a*, 32*a* or 22*a*, 42*a*, measured in a direction perpendicular to the fold lines defining the edges of these panels. With that total length, each sling 73, 74 is made from a portion of the material 70 that is about one-half pi times the length of a connected pair of bridge flaps. To ensure adequate length, the total length of sling 70 can be somewhat greater than pi times the length of a connected pair of bridge flaps.

Although the description of a preferred embodiment has been presented, it is contemplated that various changes could be made without deviating from the spirit of the present invention. In particular, the collapsible bridge panels formed from joined pair of bridge flaps could be joined in many other ways, as long as they have some type of collapse fold line. Accordingly, it is intended that the scope of the present invention be dictated by the appended claims rather than by the description of the preferred embodiment.

What is claimed and desired to be protected by Letters Patent is:

1. A collapsible package for use in heating and browning food by microwave energy comprising:

a first sling enclosure comprising a pair of parallel, opposed substantially rectangular wall panels, the opposed ends of said wall panels being joined by collapsible bridge panels, movable between a collapsed position in which the wall panels lie against each other and an extended position in which the wall panels are held in spaced relation to each other;

a second sling enclosure comprising a pair of parallel, opposed substantially rectangular wall panels, the opposed ends of said wall panels being joined by collapsible bridge panels, movable between a collapsed position in which the wall panels lie against each other and an expanded position in which the wall panels are held in spaced relation to each other, said second sling enclosure being joined to said first sling enclosure at a center fold line between adjacent wall panels of said first and second sling enclosures; and a generally rectangular strip of thin, flexible material capable of converting microwave energy into heat, one of two opposed edges of said strip being affixed to each of the two side walls of the first and second sling enclosures not connected at said center fold line, such that the portion of said flexible strip intermediate said affixed edges is draped over the two side walls joined at the common fold line to form a sling of said flexible material in each of said sling enclosures.

2. A collapsible package as recited in claim 1 wherein the center of said flexible strip intermediate the affixed edges is affixed to at least one of said side walls joined at the common fold line along a glue line adjacent said fold line.

3. A collapsible package as recited in claim 1 wherein the center of said flexible strip intermediate the affixed edges is affixed to both of said side walls joined at the common fold line along glue lines adjacent said fold line.

4. A collapsible package as recited in claim 1 wherein each said collapsible bridge panel comprises a panel connected to the wall panels that it joins at fold lines at the edges of said wall panels, and each said collapsible bridge panel has a collapse fold line located parallel to and intermediate the fold lines at which said flap joins the wall panels.

5. A blank for forming a collapsible package for use in heating and browning food by microwave energy comprising:

four substantially rectangular wall panels of substantially equal size, said panels being disposed laterally adjacent each other with the same orientation and with their end edges aligned to define two center panels and two outer panels, the center panels being joined for at least a portion of their length at a center fold line and each outer panel being joined to its adjacent center panels by short end fold lines adjacent each end of the adjacent panels;

an inner fold line extending perpendicular to said center fold line across each end of each wall panel and defining thereby eight pairs of bridge flaps, one on each end of each wall panel;

an outer fold line extending parallel to said inner fold line across each end of each wall panel and defining thereby eight pairs of outer glue tabs, one on each end of each wall panel; and a substantially rectangular piece of thin, flexible microwave absorbing material affixed to said four substantially rectangular wall panels, two opposed outer edges of said microwave absorbing material being affixed near the opposed outer edges of said outer wall panels that are parallel to said center fold line.

6. The blank as recited in claim 5 wherein an intermediate portion of said microwave absorbing material is affixed to at least one of said two center panels in an area adjacent said center fold line.

* * * * *